US007963672B2

(12) United States Patent
Liu et al.

(10) Patent No.: US 7,963,672 B2
(45) **Date of Patent: *Jun. 21, 2011**

(54) LED LAMP

(75) Inventors: Jun Liu, Shenzhen (CN); Yong-Dong Chen, Shenzhen (CN)

(73) Assignees: Fu Zhun Precision Industry (Shen Zhen) Co., Ltd., Shenzhen, Guangdong Province (CN); Foxconn Technology Co., Ltd., Tu-Cheng, New Taipei (TW)

( * ) Notice: Subject to any disclaimer, the term of this patent is extended or adjusted under 35 U.S.C. 154(b) by 190 days.

This patent is subject to a terminal disclaimer.

(21) Appl. No.: 12/475,515

(22) Filed: May 30, 2009

(65) Prior Publication Data

US 2010/0110701 A1 May 6, 2010

(30) Foreign Application Priority Data

Oct. 30, 2008 (CN) ..... 2008 1 0305281

(51) Int. Cl.
*F21S 4/00* (2006.01)
*F21V 3/00* (2006.01)

(52) U.S. Cl. ..... 362/249.02; 362/311.02; 362/800

(58) Field of Classification Search ..... 362/249.02, 362/311.02, 800, 362, 373, 375
See application file for complete search history.

(56) References Cited

U.S. PATENT DOCUMENTS

| | | | | |
|---|---|---|---|---|
| 7,244,058 | B2 * | 7/2007 | DiPenti et al. | 362/547 |
| 7,722,221 | B2 * | 5/2010 | Chae | 362/294 |
| 2010/0020542 | A1 * | 1/2010 | Teng et al. | 362/249.05 |

* cited by examiner

*Primary Examiner* — Jason Moon Han
*Assistant Examiner* — Sean P Gramling
(74) *Attorney, Agent, or Firm* — Frank R. Niranjan

(57) ABSTRACT

An LED lamp includes a housing defining an opening, an LED module received in the housing, a light-guiding cover covering the LED module and a transparent plate hermetically coupled to the housing via glue. The housing includes a main body, a pair of lateral plates secured to two opposite ends thereof and a pair of cushioning plates tightly sandwiched between the lateral plates and the two opposite ends of the main body. Each cushioning plate defines a recessed side edge, whereby two opposite end edges of the transparent plate, the recessed side edges and tops of the lateral plates cooperatively define a pair of receiving grooves at the two opposite ends of the main body of the housing. An outer edge of the transparent plate is hermetically coupled to the housing via glue filled in the receiving grooves.

12 Claims, 5 Drawing Sheets

LED LAMP

BACKGROUND

1. Technical Field

The disclosure relates to LED (light emitting diode) lamps for illumination purpose and, more particularly, relates to an LED lamp having an improved sealed structure.

2. Description of Related Art

An LED lamp is a type of solid-state lighting that utilizes LEDs as a source of illumination. An LED is a device for transferring electricity to light by using a theory that, if a current is made to flow in a forward direction through a junction region comprising two different semiconductors, electrons and holes are coupled at the junction region to generate a light beam. The LED has an advantage that it is resistant to shock, and has an almost eternal lifetime under a specific condition; thus, the LED lamp is intended to be a cost-effective yet high quality replacement for incandescent and fluorescent lamps.

Since LED lamps have many advantages, the LED lamps often act as street lamps for illumination purpose. Generally, when the LED lamp is used outdoors for illumination, the LED lamp needs to be constructed with a sealed structure to protect the LEDs in the LED lamp from damages which may be caused by rain, snow, dust or other foreign articles.

What is needed, therefore, is an LED lamp which has an improved sealed configuration.

BRIEF DESCRIPTION OF THE DRAWINGS

Other advantages and novel features of the disclosure will become more apparent from the following detailed description of an embodiment/embodiments when taken in conjunction with the accompanying drawings.

DETAILED DESCRIPTION

Referring to FIGS. 1-5, an LED lamp in accordance with an exemplary embodiment is illustrated. The LED lamp comprises a housing 10, an LED module 20 received in the housing 10, a light-guiding plate 30 located over the LED module 20 and a cover 40 hermetically engaging with the housing 10.

Figure 1:
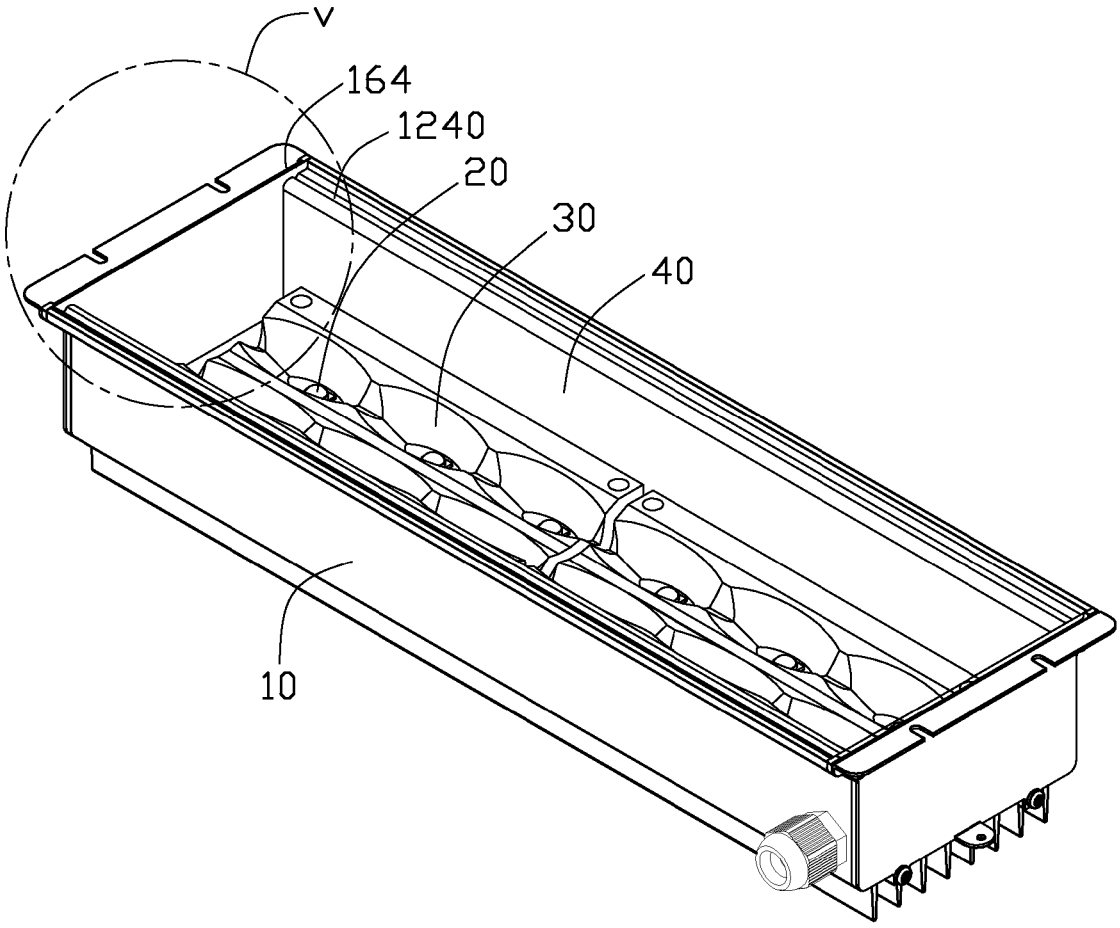
FIG. 1 is an isometric, assembled view of an LED lamp in accordance with an embodiment of the disclosure.
Figure 2:
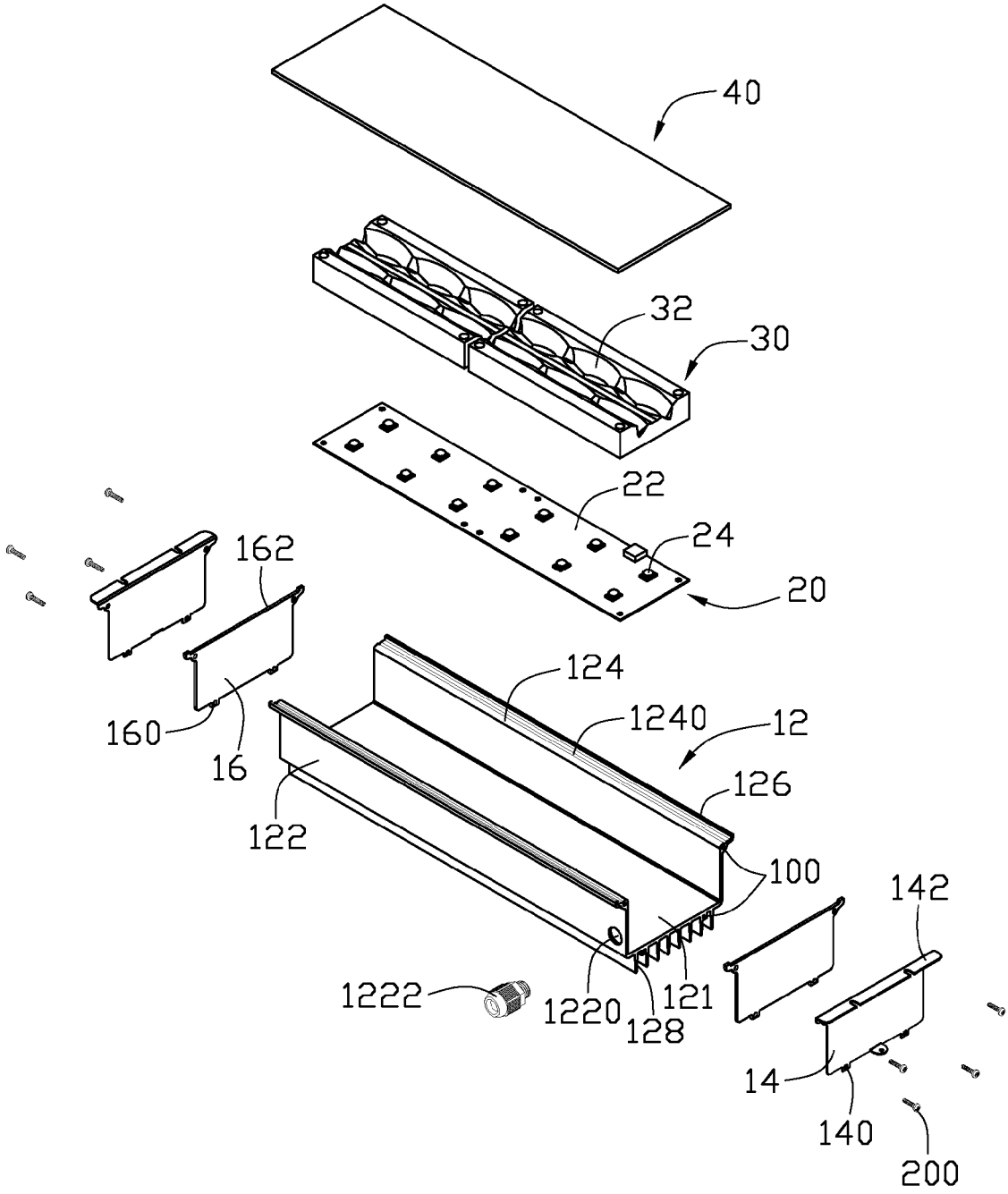
FIG. 2 is an exploded view of the LED lamp of FIG. 1.
Figure 3:
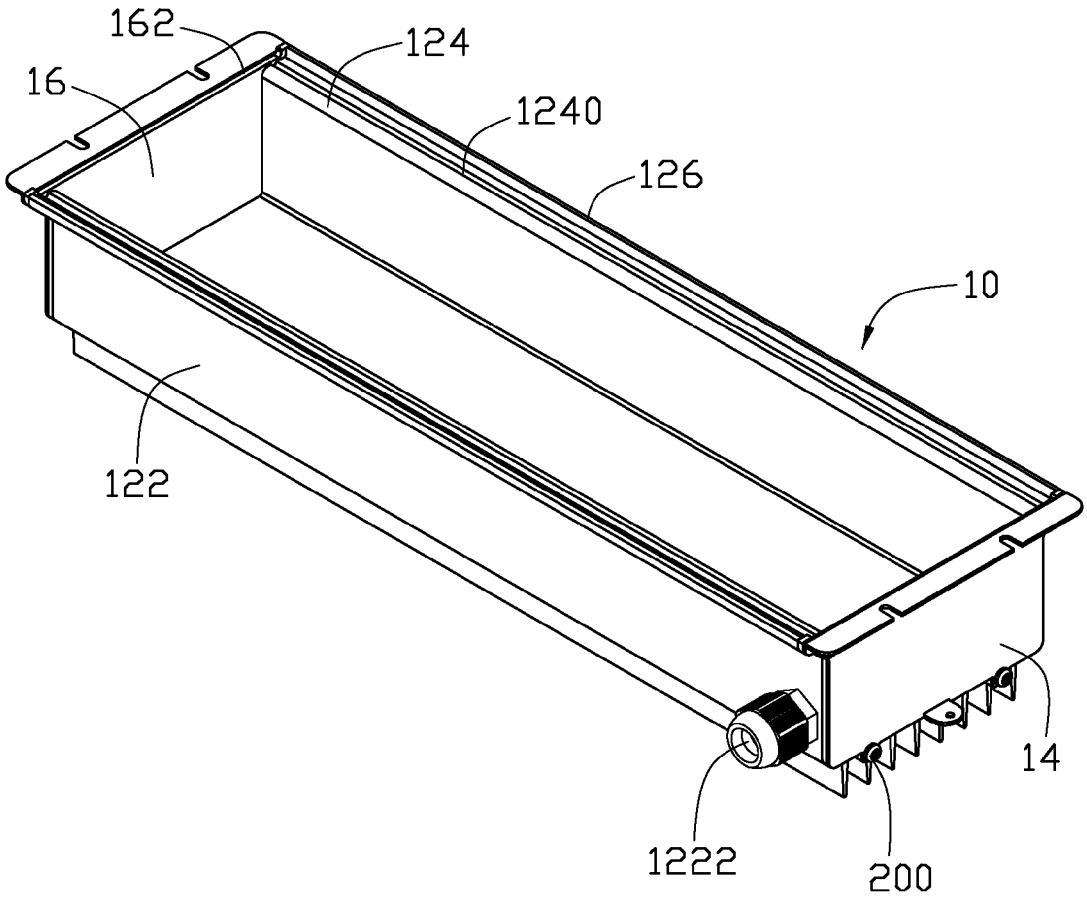
FIG. 3 is an assembled view of a housing of the LED lamp of FIG. 2.

Particularly referring to FIG. 2, the housing 10 has a shape of a cube and comprises a main body 12, a pair of lateral plates 14 fixed to two opposite short sides of the main body 12 and a pair of cushioning plates 16 respectively sandwiched between the lateral plates 14 and the two opposite short sides of the main body 12.

The main body 12 is made of a metal with good heat conductivity such as copper or aluminum, and comprises a substantially rectangular base plate 121, a pair of opposite rectangular sidewalls 122 extending upwardly and perpendicularly from the base plate 121, a pair of opposite elongated supporting flanges 124 extending outwardly from the sidewalls 122 and a pair of opposite engaging flanges 126 extending slantwise outwardly from edges of the supporting flanges 124. A plurality of fins 128 integrally extends downwardly and perpendicularly from a bottom surface of the base plate 121, although they are not limited to the disclosed embodiment regarding the configuration and position of the fins. A lengthways slot 1240 is defined in each of the supporting flanges 124, for accommodating glue therein. A circular bore 1220 is defined in a lower portion of one of the sidewalls 122, adjacent to a short side of the corresponding sidewall 122. A waterproof connector 1222 is mounted to the sidewall 122 by engaging in the circular bore 1220. The waterproof connector 1222 defines a through hole (not labeled) therein to allow a wire extending therethrough and electrically connecting with the LED module 20.

Two pairs of screwing holes 100 are defined in two opposite ends of the supporting flanges 124 and two pairs of screwing holes 100 are defined in two opposite short sides of the base plate 121. The screwing holes 100 of each pair screwing holes 100 defined in the base plate 121 are spaced from each other. Each lateral plate 14 is substantially rectangular and comprises a holding flange 142 extending outwardly from a top edge thereof, for facilitating holding the lateral plate 14 during assembly of the housing 10. Two pairs of spaced fixing holes 140 are defined in the each lateral plate 14, in alignment with the screwing holes 100 in the base plate 121 and the screwing holes 100 in the supporting flanges 124.

Figure 4:
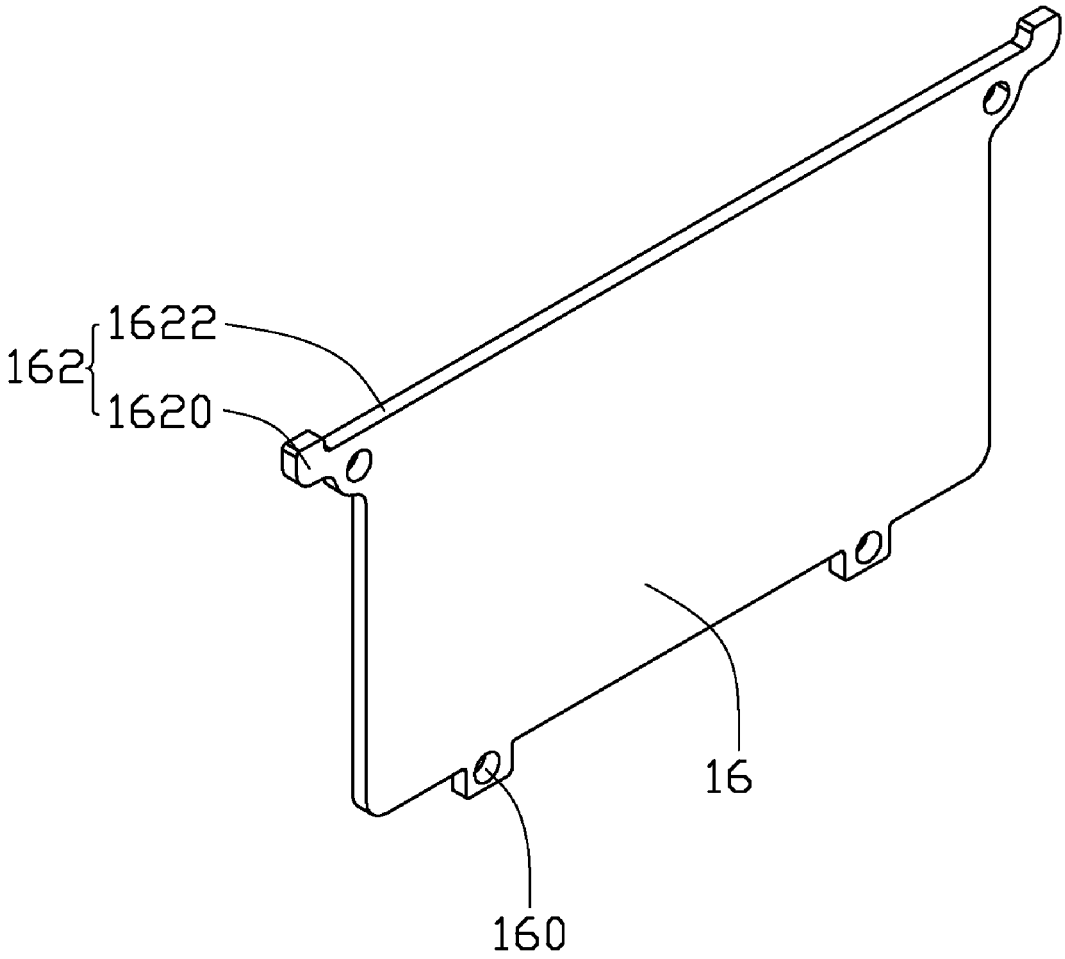
FIG. 4 is an enlarged view of a cushioning plate of the LED lamp of FIG. 2.
Figure 5:
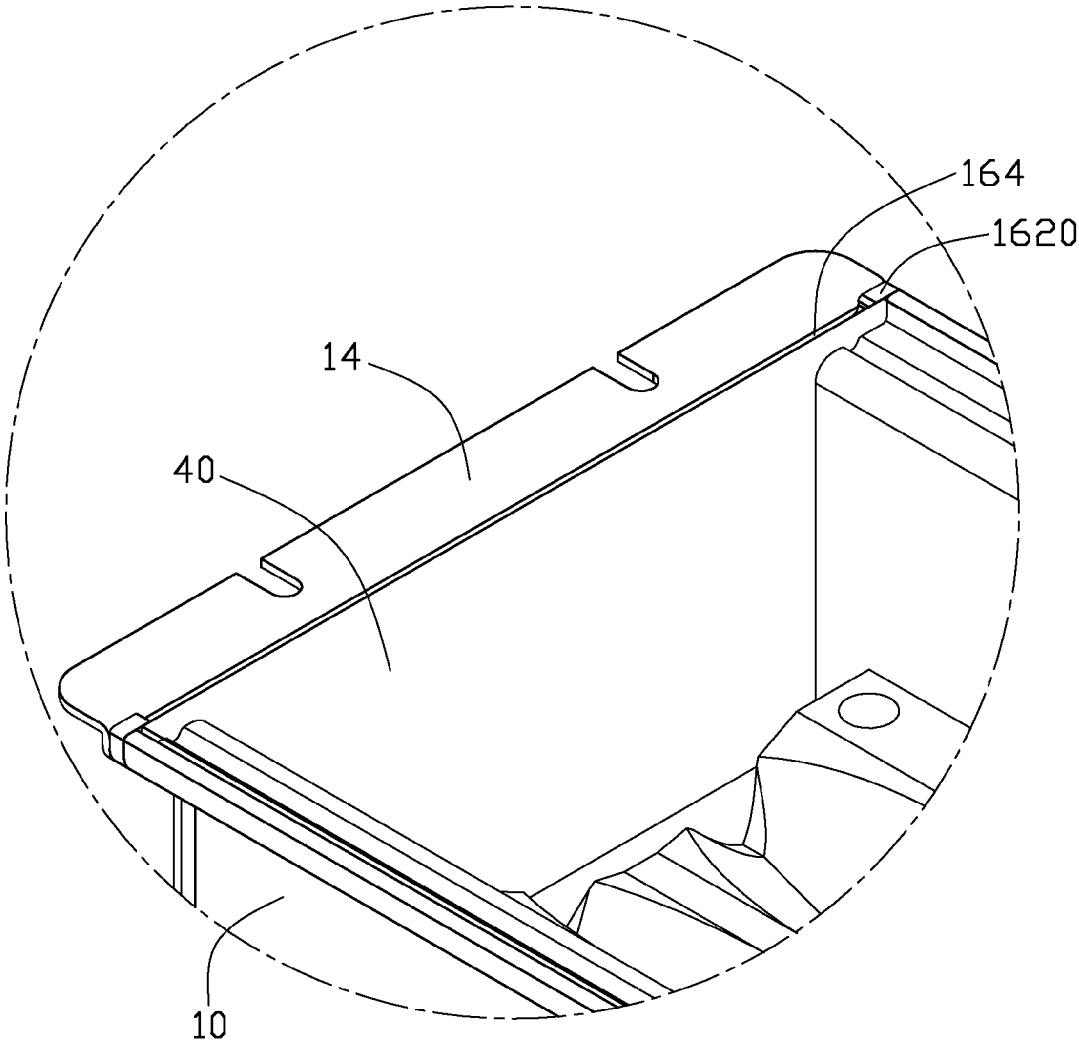
FIG. 5 is an enlarged view of a part V of the LED lamp of FIG. 1.

Particularly referring to FIG. 2 and FIG. 4, each cushioning plate 16 defines two pairs of mounting holes 160 therein, in alignment with the screwing holes 100 of the base plate 121 and the supporting flanges 124 and the fixing holes 140 of the lateral plate 14. A recessed upper side edge 162 is defined in a top of the cushioning plate 16. The recessed upper side edge 162 are cooperatively defined by two first edges 1620 and a second edge 1622 of the cushioning plate 16, wherein the second edge 1620 connects the two first edges 1620. A height between a top of each first edge 1620 and a bottom of the cushioning plate 16 is equal to a height of the lateral plate 14, and a height between a top of the second edge 1622 and the bottom of the cushioning plate 16 is less than the height of the lateral plate 14. A distance between the top edge of the lateral plate 14 and the second edge 1622 is less than or equal to a thickness of the transparent plate 40. When the lateral plate 14, the cushioning plate 16 and the transparent plate 40 are assembled together, two first edges 1620 of the recessed upper side edge 162 are sandwiched between an upper side of the lateral plate 14 and the short side edge of the transparent plate 40. Due to the exist of the second edge 1622 of the recessed upper edge 162, the upper side of the lateral plate 14, the short side edge of the transparent plate 40, the two first edges 1620 of the recessed upper edge 162 cooperatively surround a receiving grooves 164 to contain glue therein.

Screws 200 extend through the fixing holes 140 of the lateral plate 14, the mounting holes 160 of the cushioning plates 16 and screw into the screwing holes 100 of the base plate 121 and the supporting flanges 124, whereby the cushioning plates 16 are tightly sandwiched between the lateral plates 14 and the two opposite end portions of the main body 12 of the housing 10.

The LED module 20 comprises an elongated printed circuit board 22 and a plurality of LED components 24 linearly arranged thereon, along a length thereof. The LED components 24 are grouped into two columns on the printed circuit board 22.

The light-guiding cover 30 has a rectangular cross section and is made of semitransparent material. The light-guiding cover 30 has a size similar to that of the printed circuit board 22 of the LED module 20 and defines a plurality of through holes 32 in alignment with the LED components 24 of the LED module 20, thereby to allow light generated by the LED module 20 to pass therethrough.

The transparent plate 40 made of transparent material is rectangular and has a length similar to that of the base plate 121 of the main body 12 of the housing 10. A width of the transparent plate 40 is larger than that of the base plate 121 of the main body 12 of the housing 10, whereby the transparent plate 40 is attached to be supported by the supporting flanges 124 of the main body 12 of the housing 10.

To assemble the LED lamp, the LED module 20 and the light-guiding cover 30 are coupled to an upper surface of the base plate 121 of the main body 12 of the housing 10 by a plurality of fixtures (not shown) extending downwardly through the light-guiding cover 30 and the printed circuit board 22 of the LED module 20 and being screwed in the upper surface of the base plate 121 of the main body 12 of the housing 10. The transparent plate 40 is positioned on the supporting flanges 124 of the main body 12 of the housing 10 and two opposite long side edges are tightly sandwiched between the engaging flanges 126. The two opposite long side edges of the transparent plate 40 are hermetically secured to the supporting flanges 124 via glue received in the slot 1240 of the supporting flanges 124. Screws 200 extend through the fixing holes 140 of the lateral plate 14, the mounting holes 160 of the cushioning plates 16 and screw into the screwing holes 100 of the base plate 121 and the supporting flanges 124, to secure the lateral plates 14 and the cushioning plates 16 to two opposite ends of the main body 12 of the housing 10. The cushioning plates 16 are tightly sandwiched between the lateral plates 14 and the two opposite end portions of the main body 12 of the housing 10 and two short side edges of the transparent plate 40 are tightly sandwiched between the two cushioning plates 16. The receiving grooves 164 are fully filled with glue to seal the two opposite end portions of the main body 12 of the housing 10. Accordingly, the LED module 20 is received in a hermetical cavity defined between the housing 10 and the transparent plate 40.

In use, heat generated by the LED modules 20 is absorbed by the base plate 121 of the main body 12 of the housing 10 and finally dispersed into ambient cool air via the fins 128 exposed outside.

According to such a configuration of the recessed upper side edge 162 of the cushioning plates 16, four sides of the transparent plate 40 is hermetically coupled to the housing 10 via glue filled in the lengthways slot 1240 and the receiving grooves 164, thereby enabling the LED modules 20 to be sealed in the cavity cooperatively defined by the housing 10 and the transparent plate 40. Thus, the LED modules 20 can be protected from damage which may be caused by rain, snow, dust or other foreign articles.

It is to be understood, however, that even though numerous characteristics and advantages of the present embodiments have been set forth in the foregoing description, together with details of the structures and functions of the embodiments, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An LED lamp, comprising:

a housing defining an opening, comprising:

a main body comprising a pair of supporting flanges extending from two opposite sides thereof;

a pair of lateral plates secured to two opposite ends of the main body; and a pair of cushioning plates tightly sandwiched between the two opposite ends of the main body and the lateral plates, each cushioning plate defining a recessed upper edge;

an LED module thermally coupled to a bottom of the main body of the housing;

a light-guiding cover covering the LED module; and a transparent plate covering the opening of the housing, the transparent plate comprising a pair of opposite side edges supported by the supporting flanges, and another pair of opposite side edges tightly sandwiched between the cushioning plates of the housing;

wherein the another pair of opposite side edges of the transparent plate, the recessed upper edges of the cushioning plates and upper sides of the lateral plates cooperatively define a pair of receiving grooves in the two opposite ends of the main body of the housing and wherein an outer edge of the transparent plate is hermetically coupled to the housing via glue filled in the supporting flanges and the receiving grooves.

2. The LED lamp as claimed in claim 1, wherein each supporting flange defines a longitudinal slot therein, and the glue is filled in the longitudinal slot.

3. The LED lamp as claimed in claim 2, wherein the main body of the housing comprises a base plate and a pair of sidewalls extending from opposite front and rear sides thereof, the supporting flanges being extended outwardly from free ends of the sidewalls.

4. The LED lamp as claimed in claim 3, wherein the main body of the housing comprises a pair of engaging flanges extending from outer edges of the supporting flanges, the pair of opposite side edges of the transparent plate being located between the engaging flanges.

5. The LED lamp as claimed in claim 3, wherein the base plate of the main body of the housing comprises a plurality of fins extending from an outer surface thereof.

6. The LED lamp as claimed in claim 3, wherein one of the sidewalls defines a bore therein, a waterproof connector being mounted in the bore.

7. The LED lamp as claimed in claim 3, wherein the transparent plate has a width larger than that of the base plate.

8. The LED lamp as claimed in claim 3, wherein the supporting flanges and the base plate define a plurality of screwing holes at end portions thereof, fasteners extending through the lateral plates and the cushioning plates and screwing in the screwing holes to secure the lateral plates and the cushioning plates to the two opposite ends of the main body of the housing.

9. The LED lamp as claimed in claim 1, wherein the light-guiding cover defines a plurality of through holes corresponding to LED components attached on the LED module.

10. The LED lamp as claimed in claim 1, wherein the recessed upper edge comprises two first edges and a second edge connected between the two first edges.

11. The LED lamp as claimed in claim 10, wherein a top of each first edge of the recessed upper edge of the cushioning plate is located at a level the same as that of a top of the lateral plate, and a top of the second edge of the recessed upper edge of the cushioning plate is located at a level lower than that of the top of the lateral plate.

12. The LED lamp as claimed in claim 11, wherein a distance between the top of the lateral plate and the top of the second edge of the recessed upper edge of the cushioning plate is less than or equal to a thickness of the transparent plate.

* * * * *